US012747056B2

(12) United States Patent
Lin

(10) Patent No.: US 12,747,056 B2
(45) Date of Patent: Sep. 29, 2026

(54) STRAPPING MACHINE AND PACKAGING METHOD FOR THE STRAPPING MACHINE

(71) Applicant: Taizhou Xutian Packing Machine Co., Ltd., Zhejiang (CN)

(72) Inventor: Xubin Lin, Zhejiang (CN)

( * ) Notice: Subject to any disclaimer, the term of this patent is extended or adjusted under 35 U.S.C. 154(b) by 0 days.

(21) Appl. No.: 19/010,281

(22) Filed: Jan. 6, 2025

(65) Prior Publication Data

US 2026/0084853 A1 Mar. 26, 2026

(30) Foreign Application Priority Data

Sep. 20, 2024 (CN) ..... 202411316838.1

(51) Int. Cl.

| | |
|---|---|
| ***B65B 57/00*** | (2006.01) |
| ***B65B 13/02*** | (2006.01) |
| ***B65B 13/22*** | (2006.01) |
| ***B65B 13/32*** | (2006.01) |
| ***B65B 41/16*** | (2006.01) |
| ***B65B 61/06*** | (2006.01) |

(52) U.S. Cl.

CPC ..... *B65B 57/00* (2013.01); *B65B 13/02* (2013.01); *B65B 13/22* (2013.01); *B65B 13/32* (2013.01); *B65B 41/16* (2013.01); *B65B 61/06* (2013.01)

(58) Field of Classification Search

CPC . B65B 57/00; B65B 13/00–345; B65B 41/16; B65B 61/06

See application file for complete search history.

(56) References Cited

U.S. PATENT DOCUMENTS 3,858,503 A * 1/1975 Takahashi ..... B65B 13/32 100/33 PB
3,946,921 A * 3/1976 Noguchi ..... B65B 13/184 226/49
4,120,239 A * 10/1978 Pasic ..... B65B 13/22 226/10
4,155,799 A * 5/1979 Matsushita ..... B65B 13/22 53/589
4,479,834 A * 10/1984 Kobiella ..... B29C 66/49 156/73.5
4,512,844 A * 4/1985 Kobiella ..... B29C 66/1122 100/33 PB (Continued)

FOREIGN PATENT DOCUMENTS

CN 216611829 U * 5/2022

*Primary Examiner* — Dariush Seif
(74) *Attorney, Agent, or Firm* — Sam Pierce

(57) ABSTRACT

The present application belongs to the technical field of strapping machines, and particularly refers to a strapping machine and strapping method thereof. The strapping machine includes a frame, a strap storage mechanism, a looping mechanism, a tightening mechanism, a welding mechanism, and a strap cutting mechanism; the tightening mechanism includes a movable assembly, a detection roller, a detection bracket, a damping component, and a trigger device; the movable assembly first retracts the strap in the strap retracting process, then drives the detection bracket through the strap in tension, and the reel of the strap storage mechanism switches to the rotating state from the locked state, achieving the scheme of strap storage after strap retracting; when the detection bracket moves, the trigger device indirectly or directly controls the reel to release the strap.

6 Claims, 10 Drawing Sheets

(56) References Cited

U.S. PATENT DOCUMENTS 4,559,767 A * 12/1985 Takami ..... B65B 13/22 100/32
4,577,554 A * 3/1986 Brouse ..... B65B 13/28 100/31
4,782,648 A * 11/1988 Van Ottele ..... B65B 13/02 53/553
4,845,928 A * 7/1989 Sakaki ..... B65B 41/12 53/589
5,236,329 A * 8/1993 Sylvester ..... B65B 13/18 100/32
5,755,084 A * 5/1998 Dekker ..... B65B 13/04 53/589
5,809,873 A * 9/1998 Chak ..... B65B 13/22 100/29
5,823,103 A * 10/1998 Kuei ..... B65B 13/22 100/32
6,367,732 B1 * 4/2002 Bobren ..... B65B 13/184 242/564.4
6,415,712 B1 * 7/2002 Helland ..... B65B 13/22 53/589
6,708,606 B1 * 3/2004 Bell, Jr. ..... B65B 13/22 100/32
7,263,928 B1 * 9/2007 Holden ..... B65B 13/06 100/29
7,318,308 B2 * 1/2008 Schmetzer ..... B65B 13/184 53/589
9,278,772 B2 * 3/2016 Vaughn ..... B65B 13/26
9,669,953 B2 * 6/2017 Luo ..... B65B 13/06
10,351,274 B2 * 7/2019 Vaughn ..... B65B 13/06
10,513,358 B2 * 12/2019 Takidis ..... G09G 5/12
10,625,887 B2 * 4/2020 Mitsusada ..... B65B 27/08
11,040,789 B2 * 6/2021 Vaughn ..... B65B 13/32
11,305,899 B2 * 4/2022 Liu ..... B65B 13/14
11,352,154 B2 * 6/2022 Hoffman ..... B65B 13/16
11,623,775 B1 * 4/2023 Vaughn ..... B65B 13/06 100/26
12,024,320 B2 * 7/2024 Banholzer ..... B65B 13/185
2002/0116900 A1 * 8/2002 Cranston, III ..... B65B 13/32 53/399
2002/0144489 A1 * 10/2002 Hoshino ..... B65B 13/32 53/589
2003/0015619 A1 * 1/2003 Tipton ..... B65B 13/184 242/594.3
2003/0089246 A1 * 5/2003 Kawabata ..... B29C 66/49 100/8
2004/0060267 A1 * 4/2004 Shibazaki ..... B65B 13/22 53/589
2004/0200191 A1 * 10/2004 Armstrong ..... B65B 13/184 53/399
2004/0244606 A1 * 12/2004 Haberstroh ..... B65B 13/185 100/26
2004/0250697 A1 * 12/2004 Devine ..... B65B 13/18 100/26
2005/0061163 A1 * 3/2005 Kobiella ..... B65B 13/06 100/26
2007/0163209 A1 * 7/2007 Sauer ..... B65B 13/04 53/399
2008/0216449 A1 * 9/2008 Zimmerli ..... B65B 13/184 53/399
2008/0256900 A1 * 10/2008 Doyle ..... B65B 13/184 53/399
2009/0169338 A1 * 7/2009 Hataya ..... B65B 13/04 412/36
2009/0223388 A1 * 9/2009 Doyle ..... B65B 13/06 100/1
2010/0154661 A1 * 6/2010 Bobren ..... B65B 13/185 100/4
2011/0146505 A1 * 6/2011 Schwede ..... B65B 13/185 100/8
2013/0014653 A1 * 1/2013 Lai ..... B65B 13/32 100/32
2013/0014654 A1 * 1/2013 Lai ..... B65B 13/06 100/32
2013/0098252 A1 * 4/2013 Haberstroh ..... B65B 13/06 100/8
2013/0180218 A1 * 7/2013 Sakoguchi ..... G07D 11/40 53/540
2013/0284035 A1 * 10/2013 Elliott ..... B23K 31/02 219/136
2014/0083310 A1 * 3/2014 Hohn ..... B65B 57/04 100/2
2014/0298760 A1 * 10/2014 Luo ..... B65B 61/06 53/588
2016/0090201 A1 * 3/2016 Luo ..... B65B 13/32 100/25
2020/0001542 A1 * 1/2020 Englund ..... B23K 26/359
2020/0030910 A1 * 1/2020 Mårstedt ..... B29C 66/30621
2021/0206523 A1 * 7/2021 Englund ..... B29C 65/16
2021/0237917 A1 * 8/2021 Danielsson ..... B65B 13/04
2022/0024622 A1 * 1/2022 Mårstedt ..... B65B 13/32
2023/0391483 A1 * 12/2023 Tanner ..... B65B 13/22

* cited by examiner

STRAPPING MACHINE AND PACKAGING METHOD FOR THE STRAPPING MACHINE

CROSS-REFERENCE TO RELATED APPLICATIONS

The present application is based upon and claims priority to Chinese patent application No. 202411316838.1, filed on Sep. 20, 2024, the entire content of which is incorporated herein by reference.

TECHNICAL FIELD

This present disclosure belongs to the technical field of strapping machines for straps, particularly refers to a strapping machine and strapping method thereof.

BACKGROUND

CN202011120420.5 discloses a strapping machine, comprising a strap storage mechanism, which is used to store straps and supply the straps to a looping mechanism when needed; a looping mechanism, which is used to move the straps along a circular track and form a loop connected end to end; a tightening mechanism, which is used to tighten the straps in reverse and tightly bind the loop formed by the straps on the product to be tied; a welding mechanism, which is used to weld the head and tail ends of the loop into one piece; and a strap cutting mechanism, which is used to cut off the straps that are still connected outside the loop.

In the prior art, a strap retracting motor and a strap retracting roller are provided. This scheme uses the friction force of the strap clamped by the strap retracting roller to retract the strap. During actual operation, it is necessary to test the torque of the strap retracting motor and determine whether the strap is tied tightly. It has the disadvantages that, after the strapped items change, the corresponding strap retracting situation will also change, and the strap tightening mechanism needs to be adjusted to avoid the strap being strapped too tightly or too loosely; when the material of the used strap changes, the tightening mechanism needs to be adjusted to avoid strap slipping or pinching. It is relatively difficult for the tightening mechanism to adapt the strap, If the tightening mechanism clamps the strap too tightly, it will leave marks on the strap. If the tightening mechanism does not clamp the strap tightly, the strap will slip. Particularly for some thin straps, these problems are more likely to occur. In addition, the strap will be subjected to friction force when it is retracted in the looping mechanism, and the friction force will affect the tightness of the strap.

SUMMARY

The present application is to provide a strapping machine, which can strap different products and is not prone to damaging the strap, and strapping method thereof.

The purpose of the present application is so achieved in that:

A strapping machine, comprising:

a frame, a strap storage mechanism, which is used to store the straps and supply the straps to the looping mechanism when needed;

a looping mechanism, which is used to move the straps along a circular track and form a loop connected end to end;

a tightening mechanism, which is used to tighten the straps in reverse and tightly bind the loop formed by the straps on the product to be tied;

a welding mechanism, which is used to weld the head and tail ends of the loop into one piece; and a strap cutting mechanism, which is used to cut off the straps that are still connected outside the loop.

The strap storage mechanism comprises:

a reel assembly, which is used to install a reel; a locking device is provided on the reel assembly; the locking device controls the reel to be in a locked state or a rotatable state; when the reel is in the locked state, the reel cannot rotate; and when the reel is in the rotatable state, the reel supplies the straps;

a plurality of fixed rollers, which are installed on one side of the strap storage mechanism; and the fixed rollers are used for winding the straps; and a plurality of movable rollers, which are installed on the other side of the strap storage mechanism; the movable rollers are used for winding the straps; and said fixed rollers and the movable rollers coordinate to form a strap storage area.

The retracting mechanism comprises:

a movable assembly, which can be movable mounted on the frame; the movable rollers are mounted on the movable assembly; the movable assembly can move between a first position and a second position; when the movable assembly moves to the first position, the movable rollers move away from the fixed rollers for strap storage; and when the movable assembly moves to the second position, the movable rollers approach the fixed rollers for strap conveying;

a detection roller, which is used for winding the strap; and the detection roller is installed on the detection bracket;

a detection bracket, which is rotatably or movably mounted on the frame; and the detection bracket is provided with a damping component that provides a certain resistance to the detection bracket; and a trigger device, which is used to obtain the movement of the detection bracket; and when the detection bracket moves, the trigger device indirectly or directly controls the locking device to make the reel rotate.

Preferably, the damping component is an electromagnetic damper with resistance adjustable, and a gear is installed on the output shaft of the electromagnetic damper;

The detection bracket is a swing arm, the middle part of the swing arm is rotatably mounted on the frame, the lower end of the swing arm is installed with the detection roller, and a tooth surface portion is provided on the upper end of the swing arm; and the tooth surface portion meshes with the gear;

A sensing part is arranged on one side of the swing arm; and the trigger device is a sensor provided on the frame, and the sensor detects the movement of the sensing part.

Preferably, the plurality of fixed rollers and plurality of movable rollers are arranged vertically; the fixed rollers and the movable rollers are staggered with each other in the horizontal direction; the detection roller is provided in the same column as the fixed rollers; or, the plurality of fixed rollers and plurality of movable rollers are arranged horizontally; the fixed rollers and the movable rollers are staggered with each other in the vertical direction; and the detection roller is provided in the same row as the fixed rollers.

Preferably, a slide rail, a synchronous strap assembly and a drive motor are installed on the frame; and the conveying direction of the synchronous strap assembly is parallel to the slide rail;

The movable assembly is mounted on the slide rail, and the slide rail guides the movable assembly to move between the first position and the second position;

One side of the movable assembly is fixedly connected to the synchronous strap assembly; and the drive motor drives the movable assembly through the synchronous strap assembly.

Preferably, the movable assembly comprises a first movable bracket and a second movable bracket; the first movable bracket and the second movable bracket are both mounted on the slide rail; and the first movable bracket and the second moving bracket are of split structures;

The movable rollers are installed on the front side of the first movable bracket, the rope is installed on the rear side of the first movable bracket, and the other end of the rope passes through the steering roller and is hung with a counterweight;

The second movable bracket is fixedly connected to the synchronous strap assembly; and The first movable bracket is located at one side of the second movable bracket in the strap storage direction.

Preferably, a photoelectric sensor chip is provided on the first movable bracket, and a photoelectric sensor is provided on the frame; and when the first movable bracket is located at the first position, the photoelectric sensor chip triggers the photoelectric sensor.

Preferably, a shock pad is provided between the first movable bracket and the second movable bracket, and the shock pad is fixed on the first movable bracket or the second movable bracket;

The locking device on the reel assembly is an electromagnetic brake.

A strapping method for the strapping machine, the method is based on the strapping machine, and the specific steps comprise:

Step (1), in the initial state, the strap storage mechanism stores the straps normally, and the reel is in a locked state;

Step (2), perform the strap conveying action; the strap conveying roller assembly clamps the strap to convey forward, the force of the strap in the tension state is transmitted to the movable rollers, and the movable rollers and the movable assembly move from the first position to the second position; and after the movable rollers move a certain distance, the strap conveying process is completed;

Step (3), compress the front end of the strap;

Step (4), perform the strap retracting action: the strap conveying roller assembly releases the strap, and the movable assembly moves to the first position; during the movement, the movable rollers retract the strap to the inside of the strap storage mechanism, and the strap is gradually tightened; when the tension of the strap gradually increases to a set value, the detection roller is driven by the strap, and the detection roller drives the detection bracket; the trigger device on the frame detects the movement of the detection bracket; and the trigger device indirectly or directly controls the locking device to make the reel in a rotatable state;

Step (5), perform the strap storage action: the strap conveying roller assembly clamps the strap, the movable assembly continues to move toward the first position, and the reel rotates and supplies the strap to the inside of the strap storage mechanism until the strap storage is completed; and Step (6), the strap cutting mechanism completes strap cutting, the welding mechanism completes calendering; and the strapping is completed.

Preferably, the movable assembly comprises a first movable bracket and a second movable bracket; the first movable bracket and the second movable bracket are both mounted on the slide rail; and the front side of the first movable bracket is installed with the movable rollers, and the rear side of the first movable bracket is installed with a rope and a counterweight;

The second movable bracket is fixedly connected to the synchronous strap assembly, and the drive motor drives the synchronous strap assembly and the second movable bracket;

In the step (1), the first movable bracket and the second movable bracket are separated in the initial state, the first movable bracket is located at the first position under the action of the counterweight, and the second movable bracket is located at the second position;

In the step (2), the movable rollers and the first movable bracket overcome the gravity of the counterweight, the movable rollers and the first movable bracket both move a certain distance to the second position, and the strap conveying is completed;

In the step (4), the first movable bracket moves to the first position under the action of the counterweight; the second movable bracket moves to the first position under the action of the synchronous strap assembly and the drive motor; and when the first movable bracket moves to a certain extent to the first position, the strap is in a tension state, and the strap excessively conveyed in the strap conveying step has been completely retracted to the strap storage mechanism;

In the step (5), the second movable bracket continues to move toward the first position and drives the first movable bracket to move toward the first position; the reel rotates to store the strap until the first movable bracket reaches the first position; and when the first movable bracket reaches the first position, the first movable bracket triggers a photoelectric signal;

The drive motor drives the synchronous strap assembly to rotate in the opposite direction according to the photoelectric signal, the second movable bracket moves to the second position and drives the detection bracket to reset; and the electromagnetic brake locks the reel again; and When the swing arm is reset, the sensor in the upper part of the frame is triggered, and the strap is completely stored.

Preferably, in the step (5), step (6) is performed first and then step (5) after the strap conveying roller assembly clamps the strap, or, step (5) and step (6) are performed simultaneously.

Compared with the prior art, the present application has the following outstanding and beneficial technical effects:

1. A detection bracket is installed on the frame of the present application, and the detection bracket is equipped with a damping component; the damping component provides a certain resistance for the detection bracket; a detection roller is installed at the lower end of the detection bracket; the present application adopts a movable assembly to retract the strap, and when the detection bracket moves, the trigger device indirectly or directly controls the reel to release the strap; this design enables the tension of the strap during the strapping process to be controlled by the damping component, and the overall strap retracting structure is simplified; the tightening force of the strap can be conveniently adjusted as needed, thereby improving the universality and use convenience of the strapping machine; there is no need to detect the torque of the strap retracting motor, and there is no need to consider the friction force of the strap being retracted in the looping mechanism during the tightening process; and the stability and accuracy of the detection are improved, and the cost is further reduced.

2. The movable assembly of the present application adopts a split structure, and the movable assembly comprises a first movable bracket and a second movable bracket; the two parts of the structure can be separated, so that the strap conveying roller assembly and the synchronous strap assembly will not interfere with each other, ensuring that the strap is stable during conveying and the strap is not easily scratched; and the second movable bracket further ensures the accurate resetting of the detection bracket.

BRIEF DESCRIPTION OF THE DRAWINGS

In order to more clearly explain the technical solutions in the present disclosure or the prior art, drawings required in the embodiments or the prior art will be briefly described below. Obviously, the drawings in the following description are some embodiments of the present disclosure. For those skilled in the art, other drawings may be obtained from these drawings without any creative effort.

Figure 1:
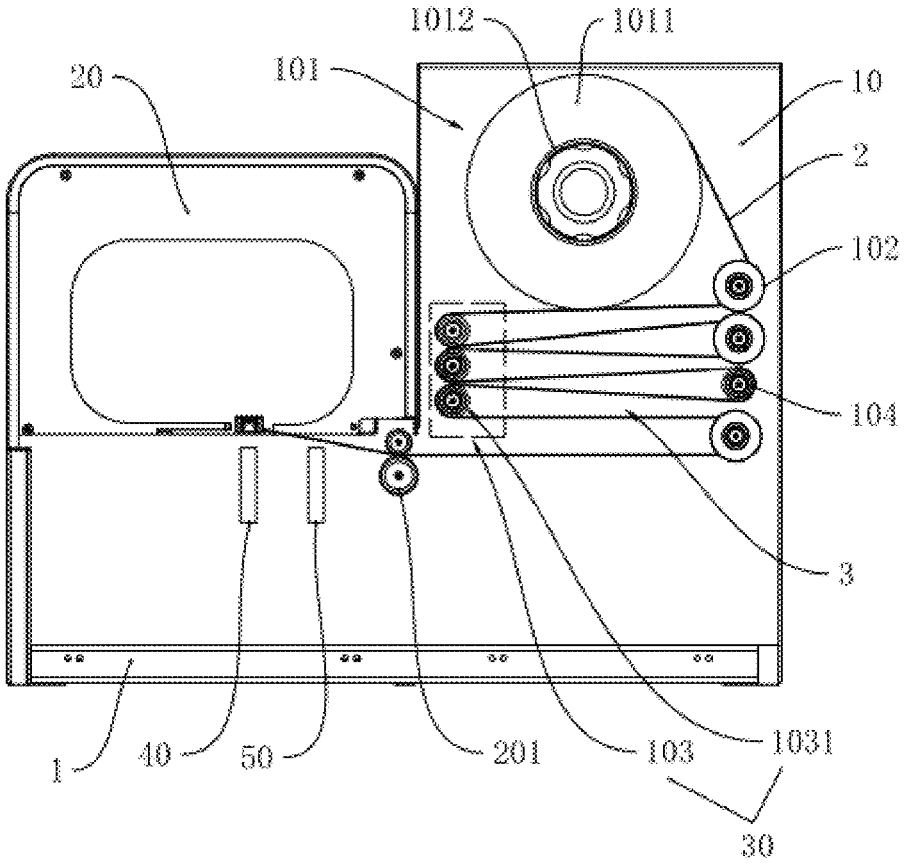
FIG. 1 is a schematic diagram of the overall structure of a strapping machine.
Figure 2:
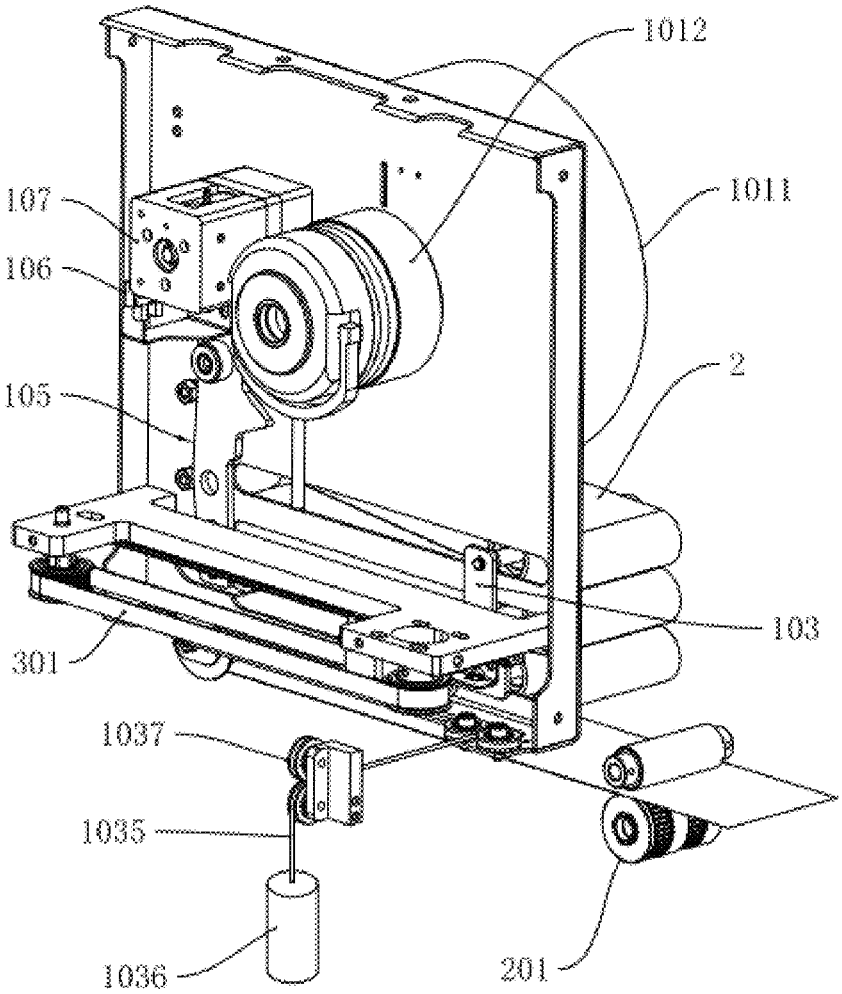
FIG. 2 is a schematic diagram of the strap storage mechanism and the tightening mechanism.
Figure 3:
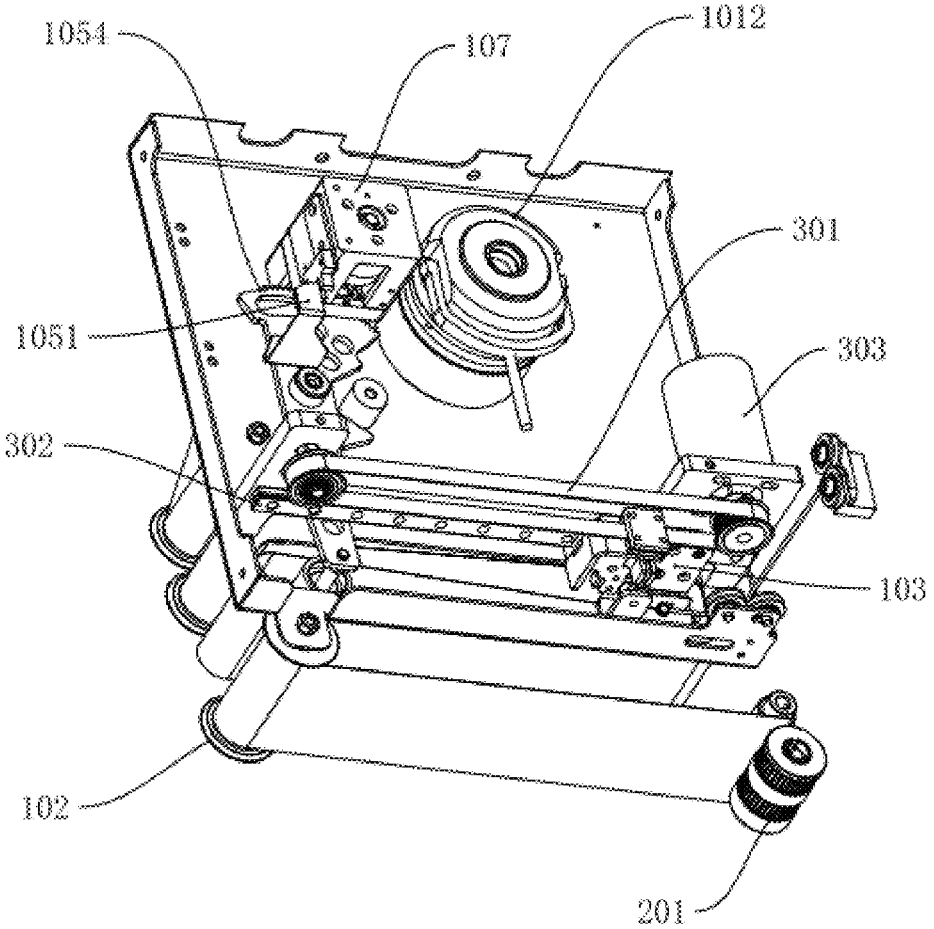
FIG. 3 is another schematic diagram of the strap storage mechanism and the tightening mechanism.
Figure 4:
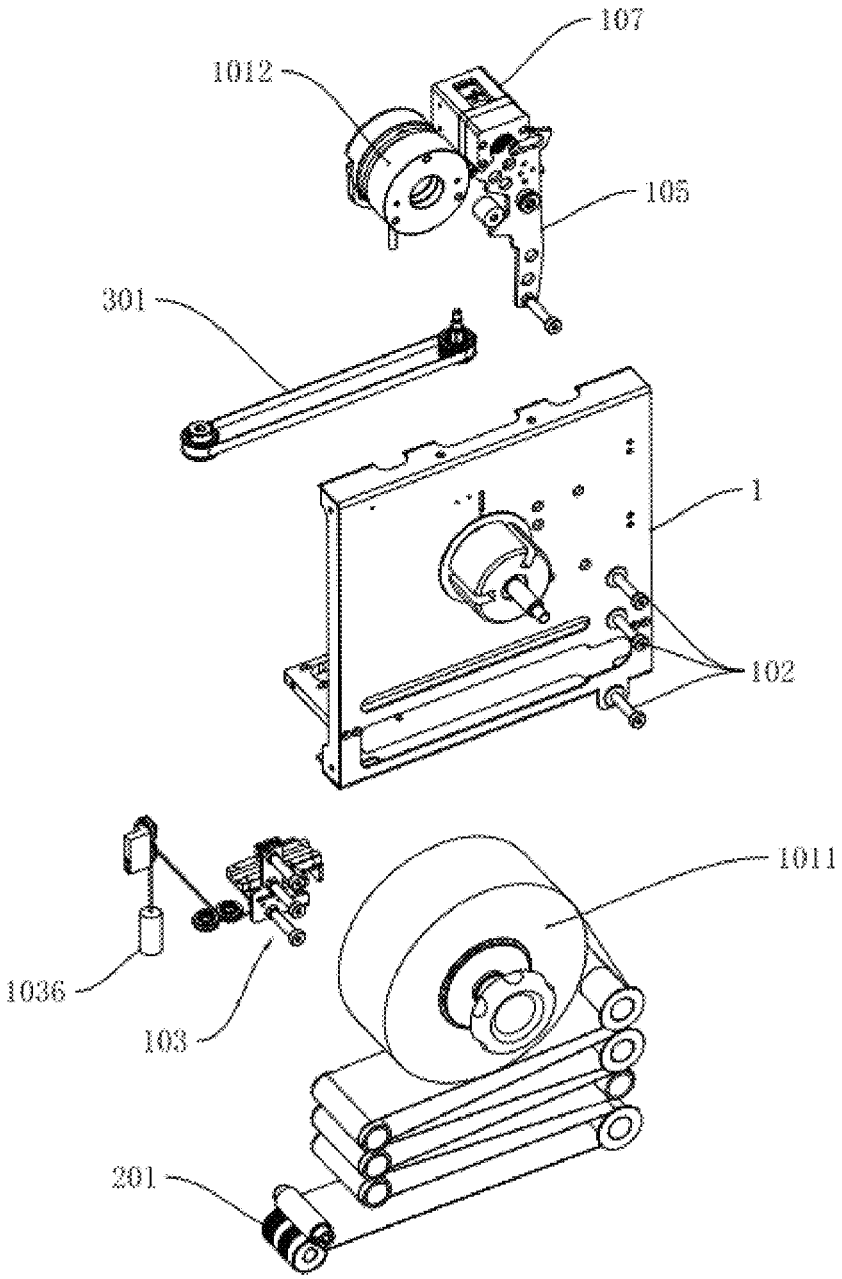
FIG. 4 is an exploded view of the strap storage mechanism and the tightening mechanism.

Reference numerals: 1. Frame; 10. Strap storage mechanism; 20. Looping mechanism; 30. Tightening mechanism; 40. Welding mechanism; 50. Strap cutting mechanism; 101. Reel assembly; 102. Fixed roller; 103. Movable assembly; 104. Detection roller; 105. Detection bracket; 106. Trigger device; 107. Damping component; 1011. Reel; 1012. Locking device; 1031. Movable roller; 1033. First movable bracket; 1034. Second movable bracket; 1035. Rope; 1036. Counterweight; 1037. Steering roller; 1038. Photoelectric sensor chip; 1039. Connecting portion; 1040. Shock pad; 1051. Sensing portion; 1052. Rotating point; 1053. Resisting portion; 1054. Tooth surface portion; 1055. Gear portion; 1071. Gear; and 201. Strap conveying roller assembly.

DETAILED DESCRIPTION OF THE EMBODIMENTS

The present application will be further described below with reference to a specific embodiment in conjunction with the drawings, see FIGS. 1 to 12:

As shown in FIGS. 1 to 4, a strapping machine, comprising:

frame 1, which is used to provide a carrier for other mechanisms and components; and the frame serves as the main structure of the strapping machine;

Strap storage mechanism 10, which is used to store the straps and supply the straps to the looping mechanism when needed;

a looping mechanism 20, which is used to move the straps along a circular track and form a loop connected end to end; the looping mechanism 20 is consistent with the prior art, and it is not described in detail in the present application; and in the present application, with the looping mechanism installed on the left side of the frame and the strap storage mechanism 10 installed on the right side of the frame, the overall height is reduced;

a tightening mechanism 30, which is used to tighten the straps in reverse and tightly bind the loop formed by the straps on the product to be tied;

a welding mechanism 40, which is used to weld the head and tail ends of the loop into one piece; and the welding mechanism 40 is consistent with the prior art, and it is not described in detail in the present application; and a strap cutting mechanism 50, which is used to cut off the straps connected to the loop; and the strap cutting mechanism 50 is consistent with the prior art, and it is not described in detail in the present application.

The strap storage mechanism 10 comprises:

a reel assembly 101, which is used to install a reel 1011; a locking device 1012 is provided on the reel assembly 101; the locking device 1012 controls the reel 1011 to be in a locked state or a rotatable state; when the reel is in the locked state, the reel cannot rotate; when the reel is in the rotatable state, the reel supplies the straps; and in this embodiment, the locking device 1012 can rotate when it is energized and locks the reel when it is disconnected with power;

a plurality of fixed rollers 102, which are installed on one side of the strap storage mechanism; and the fixed rollers are used for winding the straps; and a plurality of movable rollers 1031, which are installed on the other side of the strap storage mechanism; the movable rollers are used for winding the straps; and said fixed rollers and the movable rollers coordinate to form a strap storage area 3.

The retracting mechanism 30 comprises:

a movable assembly 103, which can be movable mounted on the frame; the movable rollers 1031 are mounted on the movable assembly; the movable assembly 103 can move between a first position and a second position;

when the movable assembly 103 moves to the first position, the movable rollers 1031 move away from the fixed rollers 102 for strap storage; and when the movable assembly 103 moves to the second position, the movable rollers 1031 approach the fixed rollers 102 for strap conveying;

a detection roller 104, which is used for winding the strap; and the detection roller is installed on the detection bracket;

a detection bracket 105, which is rotatably or movably mounted on the frame; and the detection bracket is provided with a damping component 107 that provides a certain resistance to the detection bracket;

a trigger device 106, which is used to obtain the movement of the detection bracket; and when the detection bracket moves, the trigger device indirectly or directly controls the locking device 1012 to make the reel rotate.

It should be pointed out that, the movable assembly 103 and the movable rollers 1031 are synchronously operated. Therefore, in the early stage when the movable assembly 103 is reset to the first position, the strap storage process of the strapping machine is to obtain the strap from the looping mechanism, and this strap storage process is equal to the strap retracting process; after the strap retracting is completed, the movable assembly 103 continues to be reset to the first position, and the strap is in a tension state during this process; and when the strap drives the detection roller 104, the locking device 1012 allows the reel to rotate, and the strap is obtained from the reel through the strap storage process of the strapping machine. In order to facilitate the description of the technical solution, the present application classifies the movable assembly 103, the detection roller 104, the detection bracket 105 and the trigger device 106 into the tightening mechanism 30; those skilled in the art should know that, the present application does not exclude the tightening mechanism 30 from being included in the storage mechanism 10 in whole or in part; therefore, the technical solution is expressed as: the strap storage mechanism 10 comprises the tightening mechanism 30, which also belongs to the conception and protection scope of the present application.

Preferably, the damping component 107 is an electromagnetic damper with resistance adjustable, and a gear 1071 is installed on the output shaft of the electromagnetic damper; when the items to be strapped or the strap changes, the tension of the strap needs to be adjusted during the strap retracting process to achieve a better strapping effect; and in the present application, the resistance can be adjusted and the tension of the strap during the strap retracting process can be changed by simply setting the operating current or operating voltage of the electromagnetic damper in the program. Correspondingly, if the damping component 107 is a spring, its capability to adjust the resistance will be relatively weak.

Figure 7:
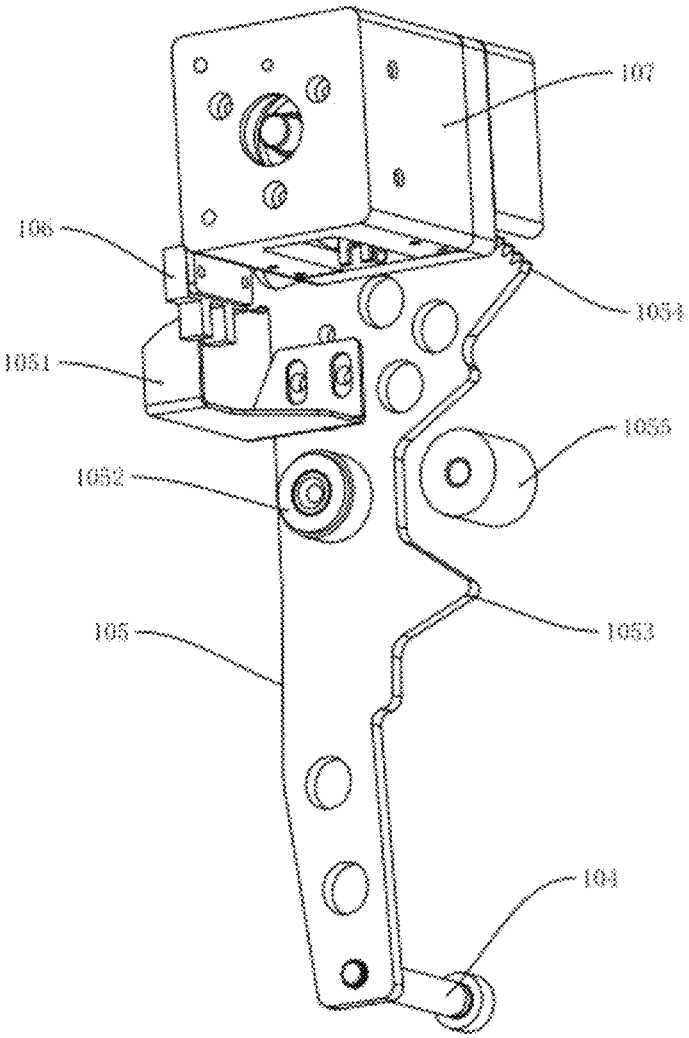
FIG. 7 is a schematic diagram showing the coordination of the detection bracket, the detection roller and the trigger device.
Figure 8:
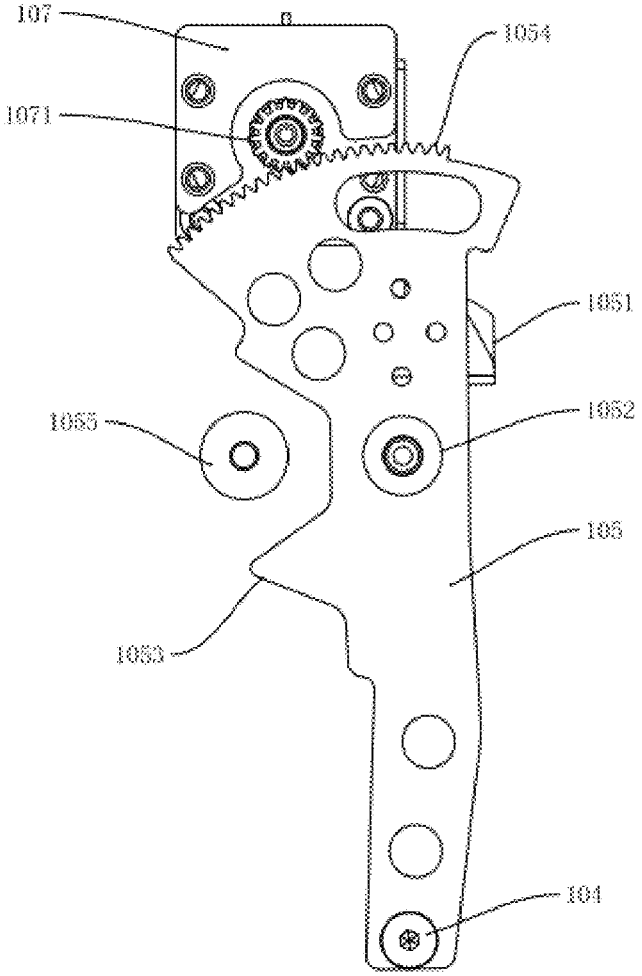
FIG. 8 is another schematic diagram showing the coordination of the detection bracket, the detection roller and the trigger device.
Figure 9:
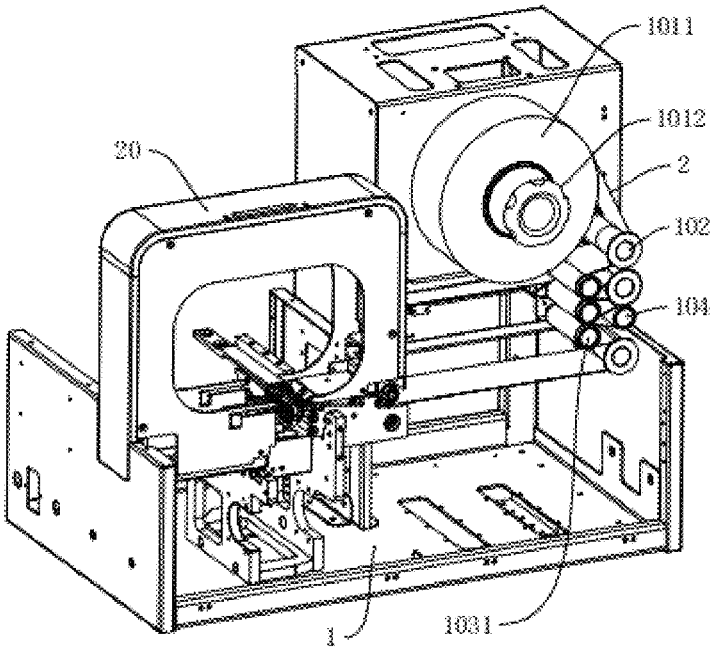
FIG. 9 is a schematic diagram for the entire strapping machine when the movable assembly is in the second position.
Figure 10:
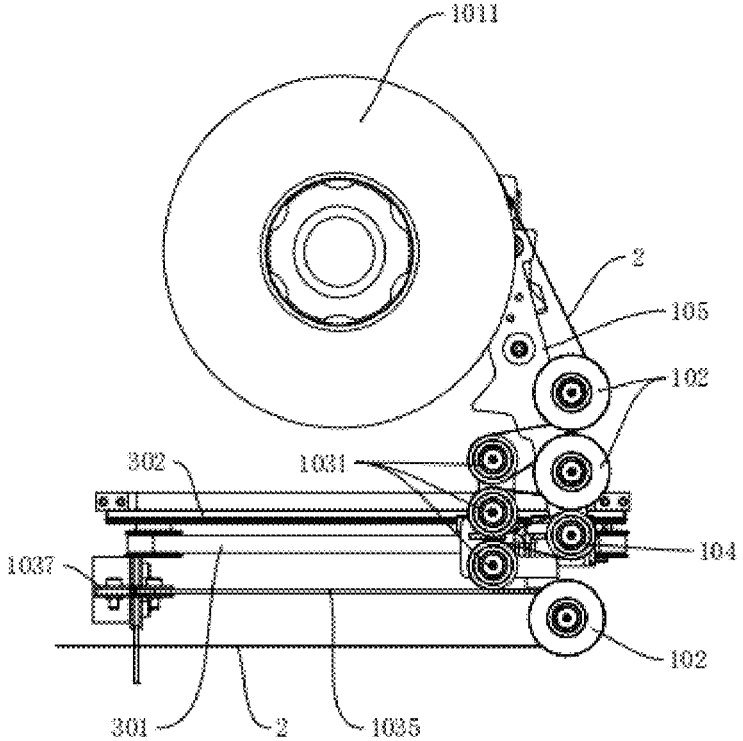
FIG. 10 is a schematic diagram for the strap storage mechanism when the movable assembly is in the second position.
Figure 11:
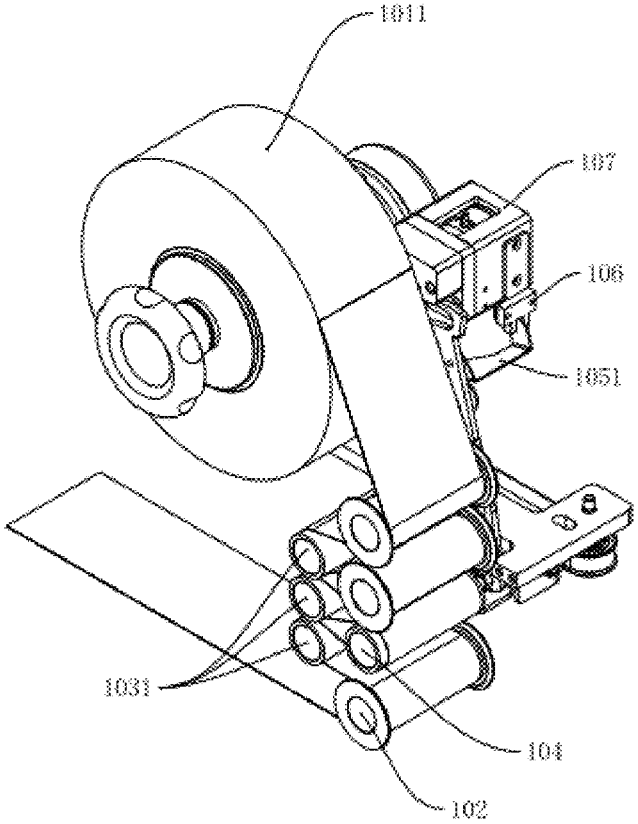
FIG. 11 is another schematic diagram for the strap storage mechanism when the movable assembly is in the second position.
Figure 12:
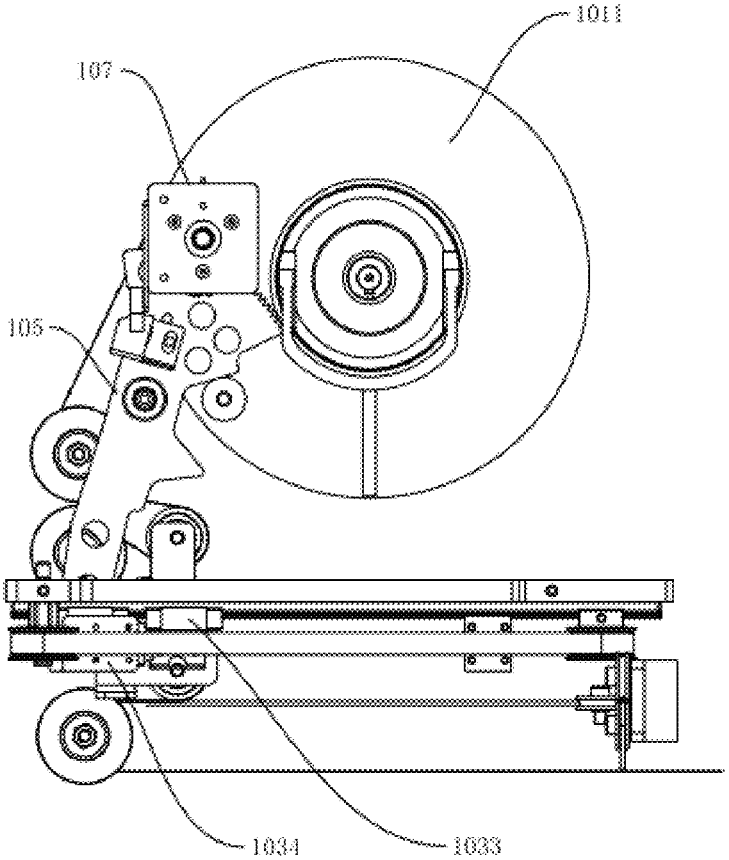
FIG. 12 is the third schematic diagram for the strap storage mechanism when the movable assembly is in the second position.

As shown in FIGS. 7 and 8, the detection bracket 105 is a swing arm, the middle part of the swing arm is rotatably mounted on the frame, the lower end of the swing arm is installed with the detection roller 104, and the upper end of the swing arm is provided with a tooth surface portion 1054; the tooth surface portion 1054 meshes with the gear 1071; the rotation point 1052 in the middle of the swing arm is located at the upper part of the swing arm, and the swing arm constitutes a simple lever structure, which enables the force at the lower part of the swing arm to be properly amplified and transmitted to the tooth surface portion at the upper part, making the detection more sensitive; the arc-shaped tooth surface portion 1054 and the gear 1071 are coordinated to achieve stability of the damping component 107, and there will be no fluctuations in resistance; a sensing portion 1051 is provided on one side of the swing arm; and the trigger device 106 is a sensor provided on the frame, and the sensor detects the movement of the sensing portion 1051. A part of the structure for the sensing portion 1051 extends between the two sensors. When the sensing portion 1051 retracts from the two sensors, the photoelectric signal between the two sensors is conducted; the controller of the strapping machine receives the corresponding photoelectric signal to control the locking device 1012, and the locking device 1012 allows the reel to rotate; a resisting portion 1053 is provided on the swing arm, and a gear portion 1055 is provided on the frame; and when the movement angle of the swing arm reaches a certain degree, the resisting portion 1053 compresses the gear portion 1055, so that the swing arm cannot continue to swing, thereby achieving the effect of safe limiting.

Preferably, the plurality of fixed rollers 102 and the plurality of movable rollers 1031 are arranged vertically; the fixed rollers 102 and the movable rollers 1031 are staggered from each other in the horizontal direction; and the detection roller 104 is provided in the same column as the fixed rollers 102. In the scheme of the present application, the fixed rollers and the movable rollers are provided on the left and right. The detection roller is provided in the middle of the queue for fixed rollers. As shown in FIG. 1, after the strap comes out of the reel, it is wound from right to left in sequence, first around a roller on the right, then around a roller on the left, and then through the strap conveying roller assembly 201 from top to bottom. As a variation, the plurality of fixed rollers 102 and the plurality of movable rollers 1031 can also be arranged horizontally; the fixed rollers 102 and the movable rollers 1031 are staggered in the vertical direction; the movable rollers 1031 are located on the lower side of the fixed rollers 102; the detection roller 104 is provided in the same row as the fixed rollers 102; and in this case, automatic strap storage can be achieved by relying on the gravity of the movable assembly 103 and the detection roller 104.

Preferably, a slide rail 302, a synchronous strap assembly 301 and a drive motor 303 are installed on the frame 1; and the conveying direction of the synchronous strap assembly 301 is parallel to the slide rail 302;

The movable assembly 103 is mounted on the slide rail 302, and the slide rail guides the movable assembly to move between the first position and the second position; as shown in FIG. 1, the movable assembly is located in the first position, which is the limit position of the movable assembly moving to the left in the actual operation process; and the limit position of the movable assembly moving to the right in the actual operation process is the second position;

One side of the movable assembly 103 is fixedly connected to the synchronous strap assembly 301; and the drive motor 303 drives the movable assembly through the synchronous strap assembly 301. By controlling the action of the movable assembly through the drive motor, the switching of the movable assembly between the first position and the second position is achieved.

Figure 5:
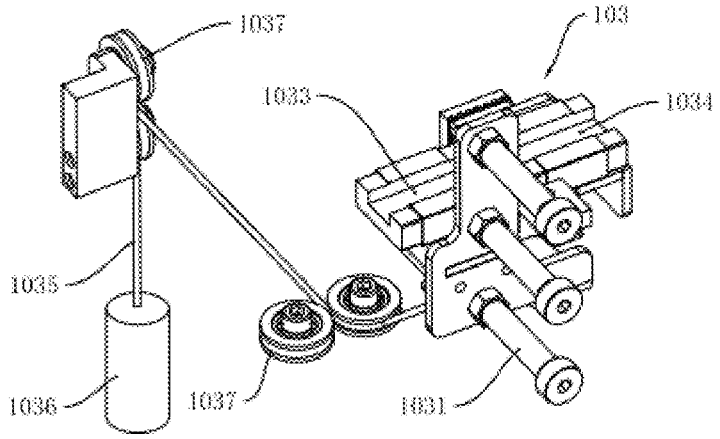
FIG. 5 is a schematic diagram for the movable assembly of the tightening mechanism.

As shown in FIG. 5, the present application also provides a modified structure: the movable assembly 103 is divided into two independent components from an integral component; the movable assembly 103 comprises a first movable bracket 1033 and a second movable bracket 1034; the first movable bracket 1033 and the second movable bracket 1034 are of split structures; and the first movable bracket 1033 and the second movable bracket 1034 are both installed on the slide rail 302;

The movable rollers 1031 are installed on the front side of the first movable bracket 1033, the rope 1035 is installed on the rear side of the first movable bracket 1033, and the other end of the rope passes through the steering roller 1037 and is hung with a counterweight 1036;

The second movable bracket 1034 is provided with a connection portion 1039, and the second movable bracket is fixedly connected to the synchronous strap assembly 301 through the connection portion 1039, and the drive motor drives the synchronous strap assembly and the second movable bracket;

Referring to FIGS. 9 to 12, the second movable bracket 1034 is located between the first movable bracket 1033 and the fixed rollers 102. After the strap storage is completed, the drive motor moves the second movable bracket 1034 to the second position, and the first movable bracket is still in the first position under the action of the counterweight; in the strap conveying stage, the strap conveying roller assembly 201 clamps the strap 2 and conveys the strap forward, and the strap overcomes the gravity of the counterweight and drives the first movable bracket; the present application will not select a very heavy counterweight, and it is desirable to select the weight of the counterweight in the way that the strap can relatively easily drive the first movable bracket; and for example, the weight of the counterweight is selected to be 1 kg. In this scheme, the first movable bracket and the second movable bracket are separated, which can further avoid the interference between the strap conveying roller assembly 201 and the synchronous strap assembly 301 during the strap conveying process.

Preferably, a photoelectric sensor chip 1038 is provided on the first movable bracket 1033, and a photoelectric sensor is provided on the frame; and when the first movable bracket 1033 is located at the first position, the photoelectric sensor chip 1038 triggers the photoelectric sensor. The principle of the photoelectric sensor chip 1038 is the same as that of the trigger device 106, and the photoelectric sensor chip is used for the controller to detect whether the resetting of the first movable bracket is completed.

Preferably, a shock pad 1040 is provided between the first movable bracket 1033 and the second movable bracket 1034, and the shock pad is fixed on the first movable bracket or the second movable bracket to avoid noise between the first movable bracket 1033 and the second movable bracket 1034 due to impact.

The locking device 1012 on the reel assembly is an electromagnetic brake, and it can be used for achieving function switchover through energization or de-energization.

A strapping method for the strapping machine, the method is based on the strapping machine, and the specific steps comprise:

Step (1), in the initial state, the strap storage mechanism 10 stores the straps normally, and the reel 1011 is in a locked state;

Step (2), perform the strap conveying action; the strap conveying roller assembly 201 clamps the strap 2 to convey forward, the force of the strap in the tension state is transmitted to the movable rollers 1031, and the movable rollers and the movable assembly 103 move from the first position to the second position; in combination with the status shown in FIG. 1, the movable assembly 103 moves from left to right; after the movable rollers 1031 move a certain distance, the strap conveying process is completed; and when the strap conveying process is completed, the position of the movable rollers 1031 is generally the middle position of the entire moving length;

Step (3), compress the front end of the strap; the compression structure is a prior art, and it is realized by configuring a cutter ejection mechanism 60; the cutter ejection mechanism 60 is a prior art, a strap threading groove is provided in the middle of the ejected cutter for the cutter ejection mechanism, and the strap is looped after passing through the strap threading groove; and the top of the ejected cutter is used to press the strap;

Step (4), perform the strap retracting action: the strap conveying roller assembly 201 releases the strap, and the movable assembly 103 moves to the first position; separate the driven roller of the strap conveying roller assembly from the strap, and the strap is pulled away by the first movable bracket; during the movement, the movable rollers retract the strap to the inside of the strap storage mechanism, and the strap is gradually tightened; as the looping mechanism has used a part of strap, the reel is locked, and the movable assembly cannot retract to the first position due to the strap length; when the tension of the strap gradually increases to a set value, the detection roller 104 is driven by the strap, and the detection roller drives the detection bracket 105; and the trigger device 106 on the frame detects the movement of the detection bracket; and the trigger device indirectly or directly controls the locking device 1012 to make the reel in a rotatable state;

Step (5), perform the strap storage action: the strap conveying roller assembly 201/or rear cutter 70 clamps the strap, the movable assembly 103 continues to move toward the first position, and the reel rotates and supplies the strap to the inside of the strap storage mechanism until the strap storage is completed; and the rear cutter 70 is a prior art, and it is used to resist the strap tightly, preventing the loop formed in the front is loose. The rear cutter resists the lower side of the position for the front end of the strap after being wounded for a circle, and the rear cutter resists upwards to compress the two layers of straps;

Step (6), the strap cutting mechanism 50 completes strap cutting, the welding mechanism 40 completes calendering; and the strapping is completed. Before cutting the strap, the rear cutter 70 shall resist the strap for strap cutting and calendering.

Figure 6:
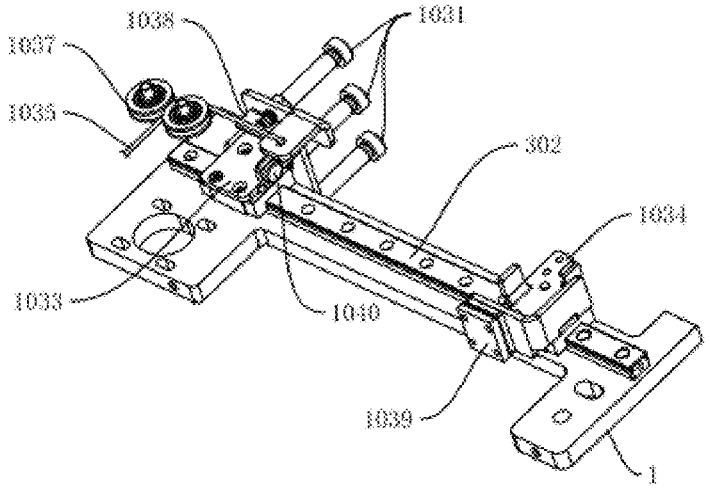
FIG. 6 is another schematic diagram for the movable assembly of the tightening mechanism.

In the step (1), the first movable bracket 1033 and the second movable bracket 1034 are separated in the initial state, as shown in FIG. 6. The first movable bracket 1033 is located at the first position or has a slight displacement with the first position under the action of the counterweight 1036. The second movable bracket 1034 is located at the second position; and the second movable bracket is located on the right side to resist against the swing arm;

In the step (2), the movable rollers 1031 and the first movable bracket 1033 overcome the gravity of the counterweight, the movable rollers and the first movable bracket both move a certain distance to the second position, and the strap conveying is completed;

In the step (4), the first movable bracket 1033 moves to the first position under the action of the counterweight; the second movable bracket 1034 moves to the first position under the action of the synchronous strap assembly and the drive motor; if the drive motor has a fast speed, the second movable bracket can catch up with the first movable bracket during the movement of the first movable bracket; when the first movable bracket moves to a certain extent to the first position, the strap is in a tension state, and the strap excessively conveyed in the strap conveying step has been retracted to the strap storage mechanism 10; the tension of the strap acts on the detection roller, and when the force of the strap reaches the force set by the electromagnetic damper, the detection roller drives the swing arm to move, and the sensor at the upper end of the swing arm is triggered; and in the actual design scheme, the gravity of the counterweight is insufficient to drive the swing arm, and the second movable bracket is required to push it;

In the step (5), the second movable bracket 1034 continues to move toward the first position and drives the first movable bracket 1033 to move toward the first position; the reel rotates to store the strap until the first movable bracket reaches the first position; when the first movable bracket reaches the first position, the first movable bracket triggers a photoelectric signal; the electromagnetic brake locks the reel again; the drive motor 303 drives the synchronous strap assembly to rotate in reverse according to the photoelectric signal, and the second movable bracket moves toward the second position and drive the detection bracket 105 to reset; when the resetting of the detection bracket is completed, the sensor on the frame is triggered, and the strap storage is completed; and the work is finished.

As a variation of the method, in the step (5), perform the step (6) first after the strap conveying roller assembly 201 clamps the strap, and then continue to perform the step (5); specifically, after the strap conveying roller assembly 201 clamps the strap, the controller controls the ejected cutter of the cutter ejection mechanism 60 to move upward and resist the strap, the cutter of the strap cutting mechanism moves upward and cuts off the strap, and the hot cutter of the welding mechanism realizes the fusion jointing of the straps; reset after the ejected cutter, the cutter, and the hot cutter complete the processes; and then perform the resetting of the detection bracket 105. It should be pointed out that, in this method, the reel is first locked before the swing arm is reset. Therefore, during the resetting process of the swing arm, the first movable bracket will move slightly to the right. It is normal and also falls within the scope of protection for the present application. The specific structure of the ejected cutter, cutter and hot cutter belongs to the prior art.

As another variation of the method, in the step (5), the rest actions of step (6) and step (5) are performed simultaneously after the strap conveying roller assembly 201 clamps the strap.

The above shows and describes the basic principles, main features and advantages of the present application. It should be understood by those skilled in the industry that the present application is not limited to the above embodiment. The description in the above embodiment and specification are only used for explaining the principles of the present application. Without departing from the spirit and scope of the present application, the present application may have various variations and improvements, which fall within the protection scope of the present application. The required protection scope of the present application is defined by the attached claims and their equivalents.

What is claimed is:

1. A strapping machine, comprising:

a frame, a strap storage mechanism, which is used to store straps and supply the straps to a looping mechanism when needed;

the looping mechanism, which is used to move the straps along a circular track and form a loop connected end to end;

a tightening mechanism, which is used to tighten the straps in reverse and tightly bind the loop formed by the straps on a product to be tied;

a welding mechanism, which is used to weld a head end and a tail end of the loop into one piece; and a strap cutting mechanism, which is used to cut off the straps that are still connected outside the loop;

wherein the strap storage mechanism comprises:

a reel assembly, which is used to install a reel; a locking device is provided on the reel assembly; the locking device controls the reel to be in a locked state or a rotatable state; when the reel is in the locked state, the reel cannot rotate; and when the reel is in the rotatable state, the reel supplies the straps;

a plurality of fixed rollers, which are installed on one side of the strap storage mechanism; and the fixed rollers are used for winding the straps; and a plurality of movable rollers, which are installed on the other side of the strap storage mechanism; the movable rollers are used for winding the straps; and the fixed rollers and the movable rollers coordinate to form a strap storage area;

the tightening mechanism comprises:

a movable assembly movably mounted on the frame; the movable rollers are mounted on the movable assembly; the movable assembly can move between a first position and a second position; when the movable assembly moves to the first position, the movable rollers move away from the fixed rollers for strap storage; and when the movable assembly moves to the second position, the movable rollers approach the fixed rollers for strap conveying;

a detection roller, which is used for winding the straps; and the detection roller is installed on a detection bracket;

the detection bracket, which is rotatably or movably mounted on the frame; and the detection bracket is provided with a damping component that provides a certain resistance to the detection bracket; and a trigger device, which is used to detect the movement of the detection bracket; and when the detection bracket moves, the trigger device indirectly or directly controls the locking device, and the locking device makes the reel rotate;

wherein the damping component is an electromagnetic damper with resistance adjustable, and a gear is installed on an output shaft of the electromagnetic damper;

the detection bracket is a swing arm, a middle part of the swing arm is rotatably mounted on the frame, a lower end of the swing arm is installed with the detection roller, and a tooth surface portion is provided on an upper end of the swing arm; and the tooth surface portion meshes with the gear; and a sensing part is arranged on one side of the swing arm; and the trigger device is a sensor provided on the frame, and the sensor detects the movement of the sensing part.

2. The strapping machine of claim 1, wherein the plurality of fixed rollers and the plurality of movable rollers are arranged vertically; the fixed rollers and the movable rollers are staggered with each other in the horizontal direction; and the detection roller is provided in the same column as the fixed rollers;

or, the plurality of fixed rollers and the plurality of movable rollers are arranged horizontally; the fixed rollers and the movable rollers are staggered with each other in the vertical direction; and the detection roller is provided in the same row as the fixed rollers.

3. The strapping machine of claim 1, wherein a slide rail, a synchronous strap assembly, and a drive motor are installed on the frame; and the conveying direction of the synchronous strap assembly is parallel to the slide rail;

the movable assembly is mounted on the slide rail, and the slide rail guides the movable assembly to move between the first position and the second position; and one side of the movable assembly is fixedly connected to the synchronous strap assembly; and the drive motor drives the movable assembly through the synchronous strap assembly.

4. The strapping machine of claim 3, wherein the movable assembly comprises a first movable bracket and a second movable bracket; the first movable bracket and the second movable bracket are both mounted on the slide rail; and the first movable bracket and the second moving bracket are of separated structures;

the movable rollers are installed on a front side of the first movable bracket, a rope is installed on a rear side of the first movable bracket, and another end of the rope passes through a steering roller and is hung with a counterweight;

the second movable bracket is fixedly connected to the synchronous strap assembly; and the second movable bracket is located between the first movable bracket and the fixed rollers.

5. The strapping machine of claim 4, wherein a photoelectric sensor chip is provided on the first movable bracket, and a photoelectric sensor is provided on the frame; and when the first movable bracket is located at the first position, the photoelectric sensor chip triggers the photoelectric sensor.

6. The strapping machine of claim 4, wherein a shock pad is provided between the first movable bracket and the second movable bracket, and the shock pad is fixed on the first movable bracket or the second movable bracket; and the locking device on the reel assembly is an electromagnetic brake.

* * * * *